US005957478A

United States Patent [19]

Vigny

[11] Patent Number: 5,957,478

[45] Date of Patent: Sep. 28, 1999

[54] RELEASE BINDING FOR TELEMARK SKIING, BACK COUNTRY SKIING, AND SKI JUMPING

[75] Inventor: Serge Vigny, Bonne, France

[73] Assignee: Salomon S.A., Metz-Tessy, France

[21] Appl. No.: 08/750,594

[22] PCT Filed: Apr. 18, 1996

[86] PCT No.: PCT/FR96/00588

§ 371 Date: Dec. 18, 1996

§ 102(e) Date: Dec. 18, 1996

[87] PCT Pub. No.: WO96/32992

PCT Pub. Date: Oct. 24, 1996

[30] Foreign Application Priority Data

Apr. 21, 1995 [FR] France ..... 95 05027

[51] Int. Cl.[6] ..... A63C 9/085

[52] U.S. Cl. ..... 280/615; 280/625; 280/613

[58] Field of Search ..... 280/614, 615, 280/611, 613, 623, 634, 625, 624

[56] References Cited

U.S. PATENT DOCUMENTS

| | | |
|---|---|---|
| 2,187,537 | 1/1940 | Bruun . |
| 2,235,164 | 3/1941 | Pfeiffer . |
| 4,152,009 | 5/1979 | Schmid . |
| 4,915,406 | 4/1990 | Graillat . |

FOREIGN PATENT DOCUMENTS

| | | |
|---|---|---|
| 0495192 | 7/1992 | European Pat. Off. . |
| 2147218 | 3/1973 | France . |
| 2377816 | 8/1978 | France . |
| 2575929 | 7/1986 | France . |
| 2595951 | 9/1987 | France . |
| 2642980 | 8/1990 | France . |

*Primary Examiner*—Richard M. Camby

*Attorney, Agent, or Firm*—Greenblum & Bernstein P.L.C.

[57] ABSTRACT

A release binding for telemark skiing, back country skiing, and ski jumping. An elastic return device maintains the front portion of the sole between a release abutment and particularly enables a lateral or diagonal disengagement of the boot, under a substantial torsional force, a rear element taking support on an insert located in the sole.

31 Claims, 4 Drawing Sheets

RELEASE BINDING FOR TELEMARK SKIING, BACK COUNTRY SKIING, AND SKI JUMPING

BACKGROUND OF THE INVENTION

1. Field of the Invention

The present invention relates to a release binding for telemark skiing, back country skiing and ski jumping. This invention also relates to an insert in the sole of the boot, which is indispensable for the functioning of the binding-boot assembly.

It relates more specifically to a binding that is adapted to ensure retention of the front portion of the boot on the ski.

2. Description of Background and Relevant Information

The bindings commonly used in the aforementioned sports are constituted by a metallic stirrup fixed on the ski and adapted to receive the front end of the boot. The boot is maintained in the stirrup by:

a journalled breeching, described in the French Patent No. 2.147.218; or a cable gripping the sole, described in the European patent No. 0.495.192.A1.

In bindings of the aforementioned type, an escape of the boot from the ski is possible only voluntarily, by opening of a latch (removal of the boot). In the case of a fall, the tip of the boot remains affixed to the ski, which can constitutes a danger for the skier in certain fall configurations, especially those with a substantial torsional component. The relative movement between the leg and the ski, which is present in this type of fall, can no longer be compensated for by increasingly rigid boots for practicing on acclivous grounds.

Certain telemark competitors use release binding initially designed for cross country skiing. This type of binding includes a rigid plate on which a previously described stirrup binding is fixed, and an assembly integrated or attached to the ski to enable the escape of the plate under a substantial torsional force. This assembly which allows safety is constituted by a single piston including a spring whose tip is housed in the front end of the plate, and by an abutment element located behind the latter, which maintains it in place under the pre-stress generated by said piston.

In the release bindings of the aforementioned type, the release releases are ill-timed due to a basic boot retention and safety system which operates with a single pre-stress. This action of the piston, in the ski axis, also causes a stiffening of the ski in the location of said plate, beneath the boot. Most spare-time and cross-country skiers consider the change in the rigidity of the skis, which are very flexible, as well as the substantial weight of the assembly of the constituent elements as serious drawbacks: safety on the ski, binding without safety and plate.

Furthermore, during an intensive practice, a majority of skiers note a pain on their toes, caused by a point transmission of the forces between the boot and the ski, in the area of the front end of the boot.

SUMMARY OF THE INVENTION

An object of the present invention is to remedy all of the aforementioned disadvantages by providing a release binding for telemark skiing, back country skiing and ski jumping, which is capable of ensuring the release of the boot, with extreme reliability, especially when an excessive torsional force develops between the boot and the ski, particularly during a fall.

Another object of the invention is to provide that this system modify the least possible the flexibility of the ski on which it is fixed, while respecting the biomechanics of the skier's foot during skiing.

These various results are achieved due to the fact that the invention builds from a release device currently adapted for alpine skiing. This element, referred to as an abutment, which enables a lateral or diagonal disengagement of the front of the boot, has recognizably proven efficient for a number of years.

The front portion of the boot is maintained in place on the ski by an elastic return means which grips the front portion of the sole between the abutment and a rear element, taking support on an insert located in the sole.

The specific shape of the front surface of the rear element enables the normal functioning of the abutment: ensuring the disengagement of the boot, under a substantial torsional force, by a rotational movement of the boot.

The elastic return means is independent of the elastic device of the abutment, adapted to adjust the release release threshold. Therefore, it is possible to adapt the hardness of this return as a function of the flexibility of the ski, without any influence on the proper functioning of the boot release device.

Due to the position of the insert affixed to the sole, located approximately beneath the metatarsal bones of the foot, the portion of the boot comprised between the front end and the insert is maintained on the ski during practice. During the genuflexion phases, the forces exerted by the rear leg are then transmitted to the ski on a surface that respects the geometry of the foot joints.

In a first embodiment of the invention, the rear element is movable with respect to the ski. It is connected to the elastic return means which is biased by a closure system. When the closure system is open, the rear element can move back and thus release the boot.

In a second embodiment of the invention, the rear element and the elastic return means are made of a known single piece which a heel of an alpine ski safety binding. Advantageously, the positioning of the boot in the binding occurs automatically by pressure of the foot.

In an alternative embodiment of the invention, only the front potion of the insert is affixed to the sole. This makes it possible to dissociate the flexion point of the boot from the rear fastening of the sole on the ski. This alternative embodiment is particularly interesting for small sized shoes.

BRIEF DESCRIPTION OF THE INVENTION

Other characteristics and advantages of the invention will become apparent from the description and the annexed drawings in which.

DETAILED DESCRIPTION OF THE INVENTION

Figure 1:
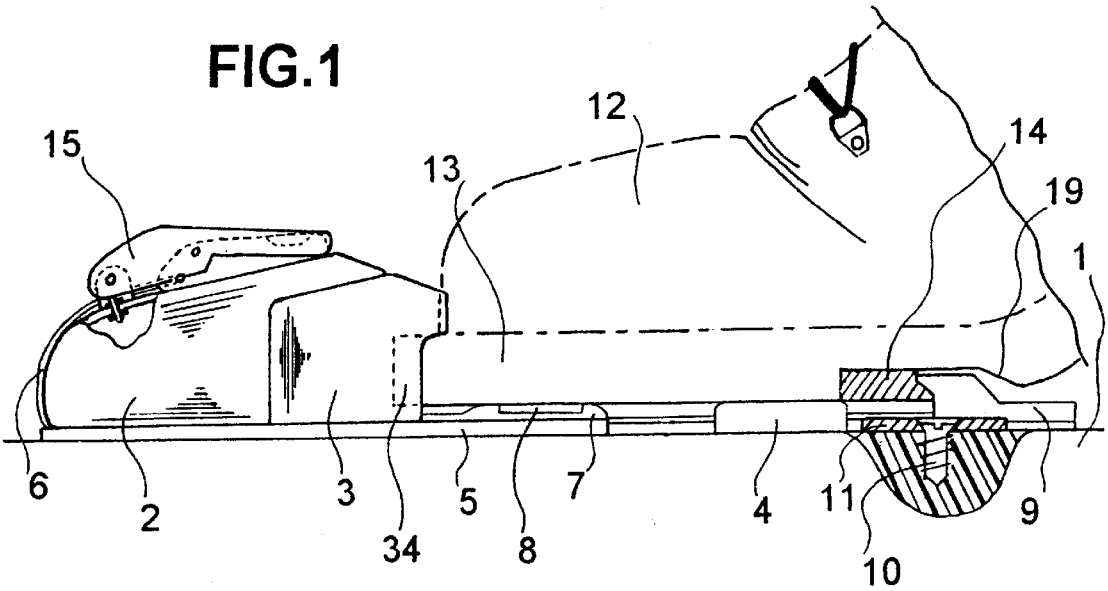
FIG. 1 is a side view of a first embodiment of a binding according to the invention.
Figure 2:
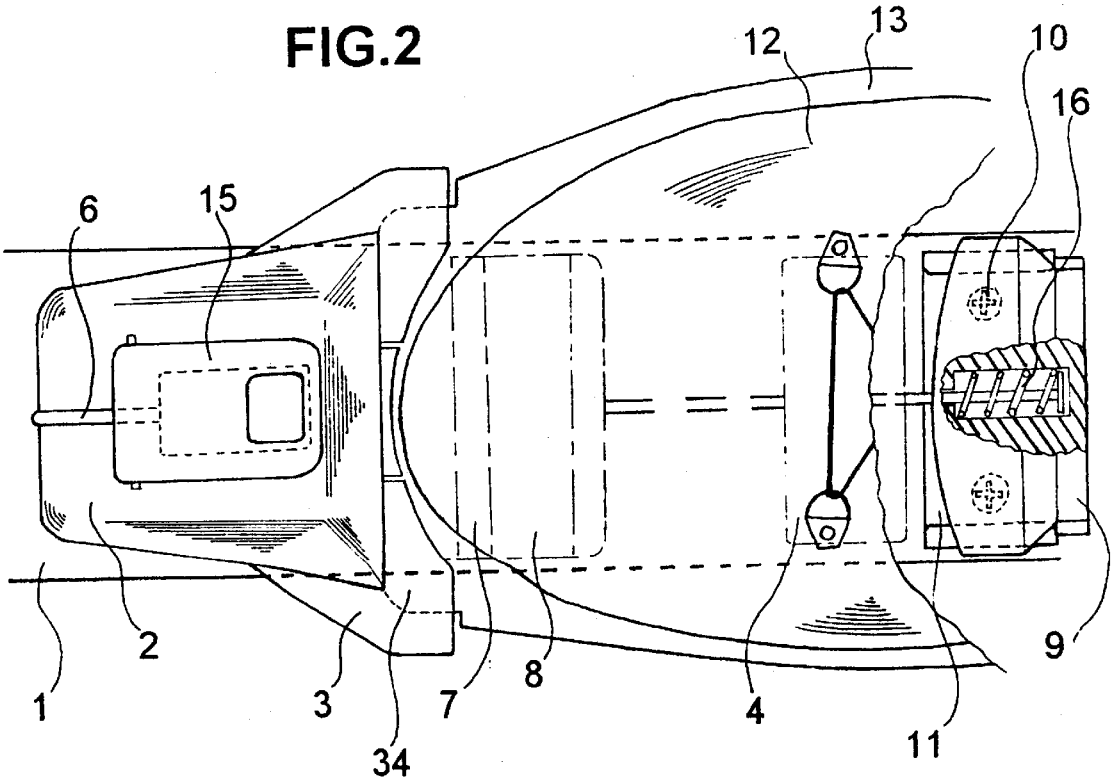
FIG. 2 is a partially exploded top view of the elements of the first embodiment of the invention, affixed to the ski.

In FIG. 1, the boot is designated by reference numeral 12, and the ski placed on a horizontal plane, of which only the upper surface is shown, is designated by reference numeral 1. The vertical axis is perpendicular to the plane of the ski and is oriented from the lower surface of the ski toward the upper surface. In the Figures, the front orientation is defined to the left side of the drawings, except for FIG. 4, a perspective view in which this orientation is defined by the left lower portion of the drawing.

An abutment 2, 3, which is a front element of the alpine ski release binding, is fixed to the ski, in front of the boot, by appropriate means such as screws 10. The functioning of this element, well known to the one skilled in the art, is not described in this document.

The front portion of the sole 13 is maintained by an elastic return means between the abutment 2, 3 which allows for a lateral or diagonal disengagement, under a substantial torsional force, and a rear element 9 which takes support on a surface of an engagement member or an insert 14.

The sole 13 of the boot comprises, at its front end, a cutout 34 based on the current standard for alpine ski boots, or an element 30 fixed by appropriate means on the boot or on the sole. This element, whose shape conforms to said standard, is highly abrasion resistant to protect the front portion of the boot and the sole from wear and tear by friction on the abutment. The front end of the sole is maintained in the vertical plane between the lower wall of the top of the movable portion 3 of the abutment and the upper wall of an antifriction plate 7. This plate 7, which is located at the rear of the abutment, can be attached to the ski by appropriate means, or integrated into the abutment 2, 3. The front end of the sole is also maintained in the horizontal plane between the two lateral wings of the movable portion 3 of the abutment.

The lower wall of the sole 13 rests on a plate 4 whose upper surface is contained in the plane defined by the upper wall of the plate 7, which is parallel to the surface of the ski. This plate, which is located at the rear of the plate 7, can be integrated into a slide 11, or can be attached to the ski by appropriate means. The plates 7, 4 can be close or made in only one piece. The upper surfaces of the plates 7, 4 are constituted, either by materials with antifriction characteristics, or by movable elements 8, referred to as movable antifriction plates and are well known, which allow for translations in the plane of the ski, or by a combination both.

An insert 14, which is fixed to the sole 13 by appropriate means, is housed in a recess 19 provided for this purpose in the boot sole. It is affixed to the sole over its entire upper surface. The rear surfaces of the insert 14 are located approximately beneath the metatarsal bones the foot positioned in the boot. In order not to hinder the walk, the lower surface of the insert 14 does not exceed the lower surface of the sole 13. The length in the longitudinal direction of the ski and the thickness of the insert are defined such that they ensure, in association with the sole 13, a sufficient rigidity between the abutment and the front wall 33 of the insert for tensioning the elastic return.

Figure 4:
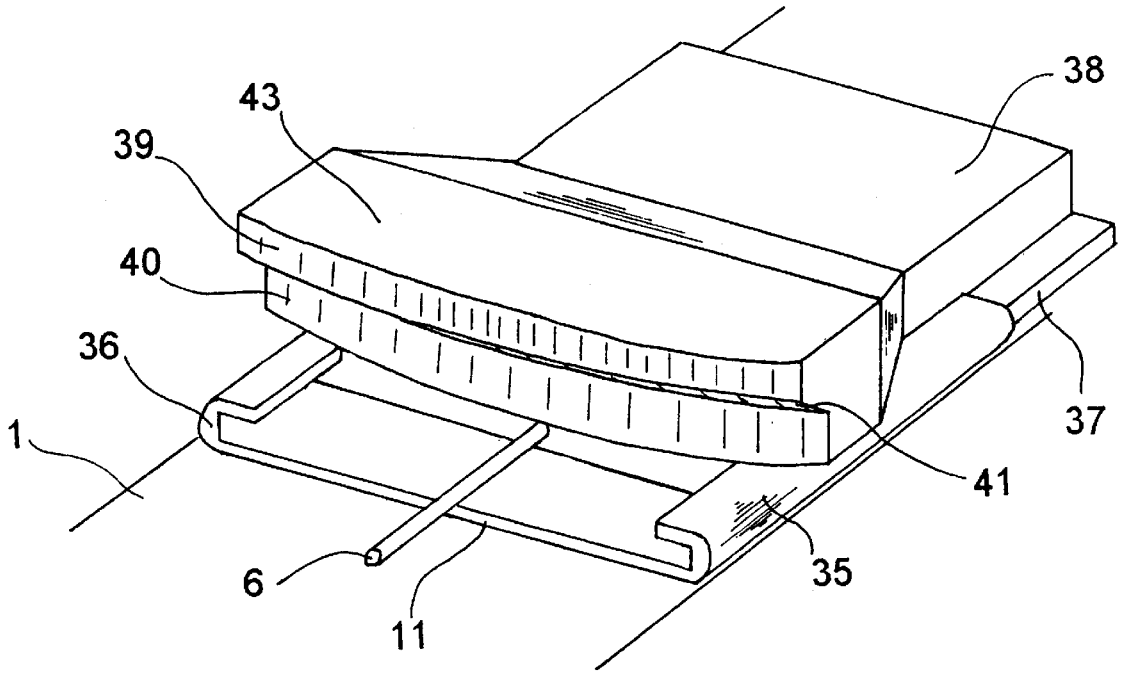
FIG. 4 is a perspective detailed view of the rear element fixed to the ski.
Figure 5:
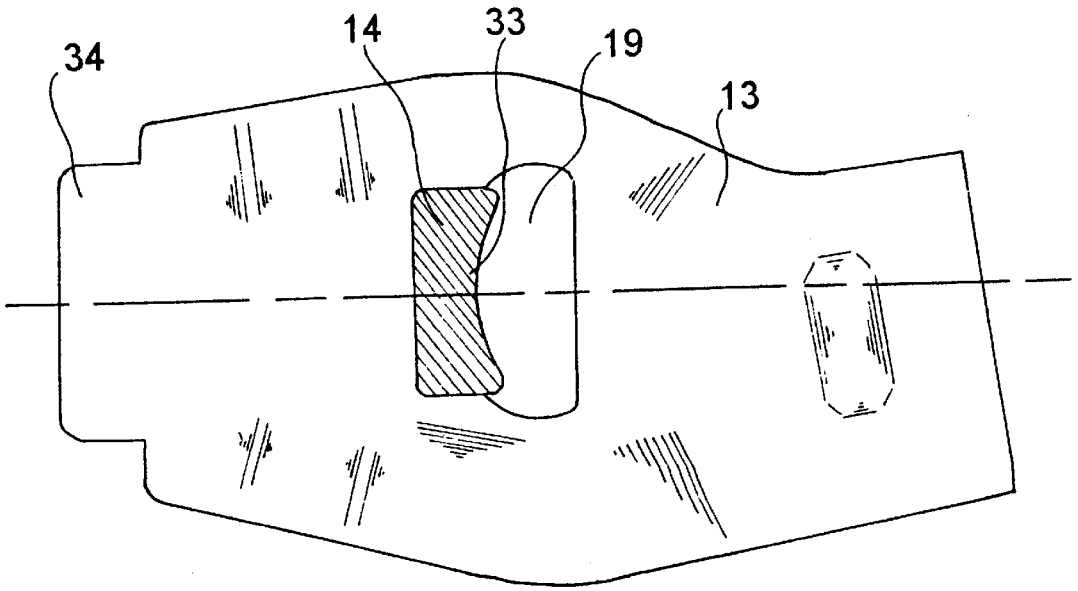
FIG. 5 is a bottom view of the elements of the first embodiment of the invention, affixed to the ski.

A rear element 9, shown in detail in FIG. 4, is translationally movable along the longitudinal axis of the ski. It is guided in a slide 11 by appropriate means such as two lower projections 37 whose shape is determined as a function of the bent lateral walls 35 of the slide, so as to allow only one axial relative displacement between the two elements. The slide 11, which can comprise antifriction coatings 36 on these internal surfaces, is then fixed on the ski by appropriate means such as screws 10, along the longitudinal axis of the ski. The rear element 9 and its slide 11 are located on the ski behind the plate 4 and the rear element is located behind the rear surfaces of the insert 14. A spring, not shown in the Figures, can possibly complete the connection between the slide 11 and the rear element 9 in order to ensure an automatic backward movement of the rear element when the binding is opened. One of the ends of this spring, whose axis coincides with the longitudinal axis of the ski, is fixed by appropriate means either on the slide 11, on the side of the abutment, or on the rear wall of the plate 4, whereas its other end is in contact with one of the front surfaces of the rear element 9.

The front surface 41 of the rear part describes a portion of a surface having an axis of revolution located in the plane defined by the vertical, the longitudinal axis of the ski and the center of the ski. A portion of the trace of this surface in the previously defined plane is an inverted inclination curve. That is, the abscissa of this curve is increases forwardly as a function of the height. The simplest example is a cone with a vertical axis whose radius increases as a function of the height. The connection between the inverted surface 41 and the raised portion 43 of the rear element is constituted by a wall 39 of any inclination whose height is determined to resist the vertical pull-out forces exerted by the insert 14. The connection between the front surface 41 and the lower base of the rear element is constituted by a wall 40 of any inclination. The raised portion 43 of the rear element becomes housed in a recess 19 provided for this purpose in the lower wall of the sole 13. One of the surfaces of the front wall 33 of the insert 14 has a geometry that is complementary of the surface 41 so that the contact surface between the insert 14 and the rear element 9 is maximum.

The contact between these two elements is provided by an elastic return means constituted either by the elasticity of a tensioned cable 6, or by a combination of the cable 6 and a spring 16.

One end of the cable 6, that can be single or double, is connected by appropriate means to the rear element 9. The cable then passes in a housing reserved for this purpose in the thickness of the plate 4; it then passes beneath the antifriction plate 7 and the abutment 2, 3, in a housing provided for this purpose in the thickness of a raising plate 5. It finally reaches the closure system 15 to which its other end is connected by appropriate means. The cable 6 can also comprise a micrometric length adjustment, which is well known to one skilled in the art, and which does not appear in the Figures.

The raising plate 5, which is located between the lower surfaces of the abutment and of the antifriction plate and the upper surface of the ski 1, is bored through its thickness by the retained binding means to maintain the abutment. Its thickness is defined such that it makes it possible to limit the contact of the lateral portion of the sole with the snow, during edge settings with a substantial inclination of the ski.

The closure system 15 is constituted by an element 27 that comprises two lateral wings 26 perpendicular thereto, through which a main axis 24 is maintained by appropriate means. This main axis, which can have multiple portions, also extends through the end of the lever 21 for which it serves as an axis of rotation, located in a horizontal plane and perpendicular to the longitudinal axis of the ski. A second axis 23, located in the same direction as the main axis, connects the levers 21 and 22 with a degree of freedom of rotation via appropriate means. The cable 6 is hooked by appropriate means on the lever 22, in a location 25 that is not strictly located between the axis 23 and the end of the lever 22 on the side where the cable is coming from. The cable 6 passes between the wings 26 or on the outside, depending upon whether the cable is single or double, respectively.

Figure 3:
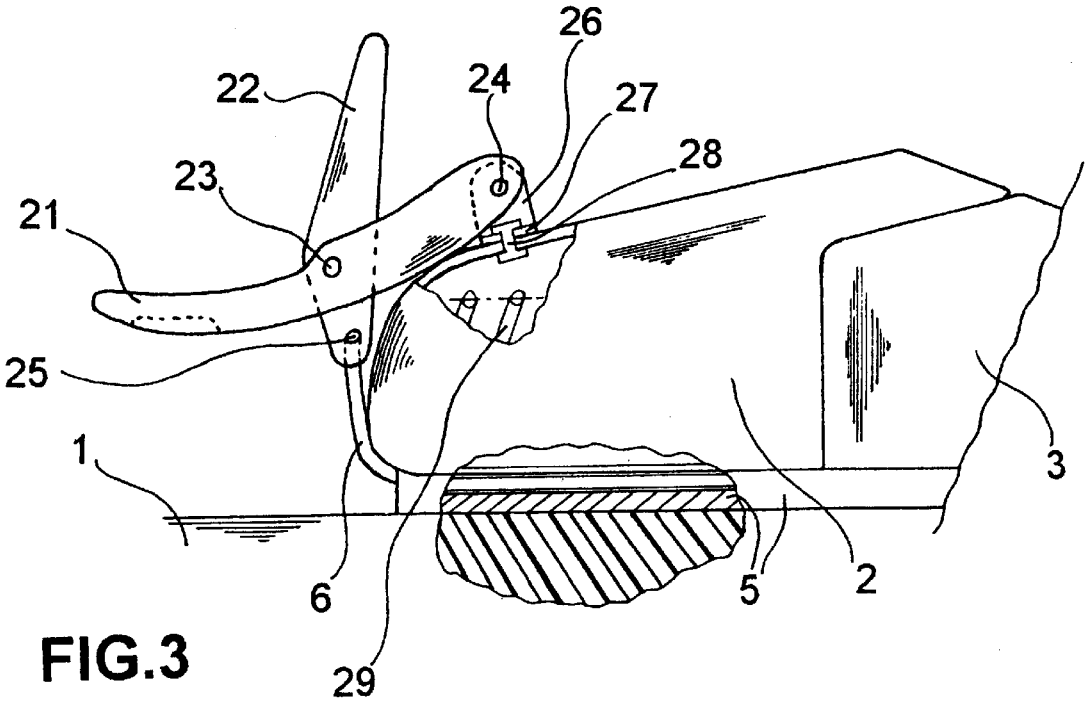
FIGS. 3 and 3A are details of FIG. 1 illustrating the functioning of the closure device, in an open and closed position, respectively.
Figure 3A:
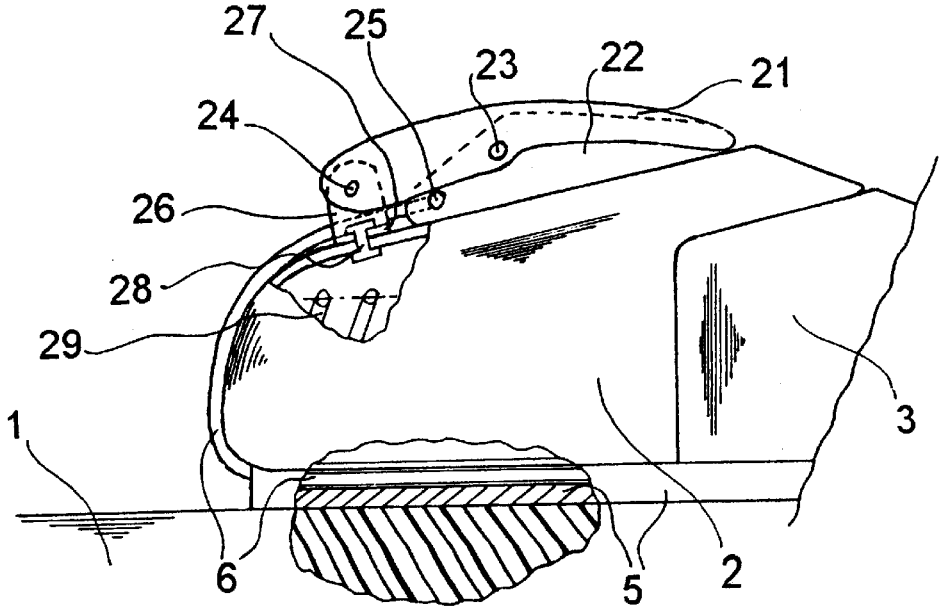

The closure system 15 is attached to the fixed body 2 of the abutment by appropriate means such as rivets 28 (see FIGS. 3 and 3A). The rivet maintains the element 27 in contact on the abutment. The cable portion located between the raising plate 5 and the closure system 15 then takes support on the front surface of the fixed body 2 of the abutment. If the fixed body of the abutment is overly angular on its front surface, a specific element, not shown in the Figures, can be attached thereto by appropriate means. The front surface of this element, in contact with the cable, has a small curvature adapted to the diameter of the cable so that the latter can slide thereon without any difficulty. Another possibility, not represented in the Figures, is to attach the closure system 15, more particularly the element 27, on the ski by appropriate means such as screws. In this case, the closure system is positioned at the front of the abutment after being subject to a vertical symmetry, with respect to the Figures.

The mechanical characteristics of the spring 16 are selected such that the rigidity of the spring is less than the elastic rigidity of the cable 6.

This spring 16 can be placed at one end of the cable 6, taking support on the surface directed toward the cable while the tension of the cable is applied on the other surface by appropriate means. If it is positioned on the side of the rear element 9, the latter can be housed in a recess provided for this purpose in the body 38 of the rear element. The front surface of the spring takes support on the rear surface, the other surface also takes support on the rear surface of the housing provided in the body 38 of the rear element when the tension exerted by the spring decreases. The geometries of the body 38 and of its housing are defined such that the rear element 9 mechanically resists the pre-stress of the spring 16. Moreover, the upper surface of the body 38 is located beneath the lower surface of the sole 13 in order not to prevent the skier from placing the boot in a flat position. If the spring is positioned on the side of the closure system, the latter can be housed in this system or in the lever 22 according to a known technique. The spring, if consistent with the invention, can also be placed in any area along the path of the cable, which is then cut into two portions whose adjacent ends are connected to the ends of the spring by appropriate means.

In order to position the boot in the binding, the front end of the sole 13 is introduced in the location provided for this purpose in the abutment 2, 3. A slight pressure is then applied forwardly in the longitudinal axis of the ski so as to block the front end of the sole against the vertical rear walls of the movable portion 3 of the abutment. The rear of the boot is simultaneously lowered to place the lower wall of the sole in contact on the plate 4. This operation is only possible if the closure system 15 has previously been opened, which causes the rear element 9 to move back according to a mechanism whose functioning is described subsequently.

The binding is closed so that the front portion of the boot is maintained in placed on the ski without it being necessary for the skier to constantly exert a specific action.

When the closure system 15 is attached on the abutment, the closing action consists of voluntarily pulling the lever, or manipulation element 21 back toward the boot that displaces the point 25 for hooking the cable. The cable slides on the front portion of the fixed body of the abutment and in the housings of plates 5, 4; its other end tends to displace the rear element forwardly (to the left in the Figures) on its slide. When the closure system 15 is attached on the ski, the closing action consists of voluntarily folding the lever 21 back toward the front of the ski (to the left in the Figures) which displaces the point 25 for hooking the cable. The cable slides in the housings of the plates 5, 4 and tends to displace the rear element forwardly on the slide.

This displacement, independently of the support of the closure system, places the rear element in contact on the insert of the sole, whereas the lever 21 is not yet in a closed position. The skier then exerts on the lever 21 a pressure which generates a moment along the main axis 24. This moment is balanced by a tension generated in the cable, at a distance from the main axis. This tension biases the rigidity of the front portion of the sole, located between its front end and the insert, which blocks the displacement of the rear element. As soon as the cable passes beneath the main axis 24, the tension in the cable readily closes the closure system 15 by placing either the lever 21 or 22, or the levers 21, 22 in contact on the upper surface of the support of the system. At that moment, the cable exerts a force on the rear element 9, whose component is horizontal, along the longitudinal axis of the ski and oriented forwardly.

If the cable 6 is completed by a spring 16, the role of the spring is to maintain an almost constant tension in the cable during the deformations of the ski. The spring 16 works in two different manners depending upon whether it is positioned at the ends of, or along, the cable. Positioned at the end of the cable, it works in compression. If the distance between the abutment and the rear element increases during the movements of the ski, it compresses and exerts a slightly greater force on the rear element 9. Positioned along the cable, it works in traction. If the distance between the abutment and the rear element increases during the movement of the ski, it extends and maintains a constant practical tension in the cable.

In the contact area between the insert and the rear element, the horizontal component of the tension is transformed, by the inclination of the surface 41 of the rear element 9, into horizontal reactions toward the front and into vertical reactions toward the base of the same rear element 9 on the insert 14. These reactions respectively maintain the front end of the sole in the abutment and vertically press the sole against the upper surface of the plate 4, at the level of the insert. At the rear, the lateral retention is ensured by the geometry of the surface 41, which prevents a rotation of the boot on the abutment with respect to its front end.

If a relatively substantial torsion develops between the boot and the ski, especially during a fall, the boot tends to separate from the ski by biasing the lateral or diagonal release of the safety of the abutment.

By being capable of sliding about the surface 41 of the rear element 9, through its contact at the level of the insert, the front portion of the boot has a tendency to make a rotation in the plane of the ski and thus exerts lateral forces on the abutment 2, 3. By biasing its spring 29, the abutment deforms laterally according to a known technology. When the lateral forces exceed the threshold set by the adjustment of the spring 29, the abutment does no longer laterally retain the boot, which is then disengaged with a rotation whose axis corresponds to the axis of revolution of the surface 41. The choice of an axis of rotation, whose intersection with the plane of the ski is located between the rear element 9 and the location corresponding to the heel, makes to possible to respect, at best, the natural axes of rotation of the leg, i.e., beneath the metatarsal bones, in the genuflexion position, and beneath the tibia, in the flat position of the boot. This makes it possible to reduce the risks of traumatism for the skier's joints during the disengagement of the boot. Nevertheless, the choice of a center of rotation located between the insert 14 and the rear element of the abutment remains consistent with invention.

If one desires to voluntarily disengage the boot from the binding, traction must be exerted upwardly on the end of the lever 22, on the side opposite the main axis 24. This results in opening the closure system (see FIG. 3) as soon as the force exerted by the cable passes above the main axis 24. The pivoting of the lever 22 about the axis 23 brings the fastening 25 of the cable closer to the raising plate 5 and allows a backward motion of the other end of the cable and also of the rear element. If the elastic return of the spring 16 is completed, the coming closer of the fastening 25 will reduce the tension in the cable until placing the two surfaces of the spring 16 into abutment in the housing where it is located. The tension is eliminated and allows a backward motion of the end of the cable and thus of the rear element, since the locked spring no longer has a tendency of bringing the rear element back forwardly. A voluntary movement of the boot, for example a rotation in the plane of the ski, causes the rear element 9 to move back (to the right in the Figures) on its slide 11, thus enabling the release of the boot via a forward tilting. A supplemental spring, not shown in the Figures, can possibly complete this system. Compressed when the binding is closed, it is released when the closure system is opened, by automatically displacing the element 9 rearwardly.

It is advisable to mention that any abutments for alpine ski safety bindings, which are capable of containing a spring of substantial rigidity, can be used for the invention. Nevertheless, if one chooses to attach the closure system 15 on the abutment, those which have a fixed body 2 with respect to the ski and one or more movable portions 3 which release the boot, are preferred.

Generally, the closure system 15 described can be replaced by any other known cable tensioning system, especially those used as a hook for the boot, while remaining consistent with the invention.

The choice of the geometrical form for the surface 41 of the rear element is determined by the abutment 2, 3 retained for the embodiment. The movement described by the movable portion 3 of the abutment, during the disengagement of the boot, and the form of the surface 41 must be compatible with the rigidity of the front portion of the sole so that the contact between the rear element 9 and the insert 14 is maximum, all along the movement. For example, for a lateral disengagement, a cone with a vertical axis is suited for the desired geometry.

Advantageously, the plates 4 or 7, or one of these plates, can be replaced by a well known ski brake. If not, the binding must be provided with an equally known strap connecting it to the skier to prevent the ski from taking off.

As in the present description, the boots used for the binding can be modified existing boots. One can also develop specific boots and soles which integrate the constructive characteristics of the insert and of the front end in their design and manufacture.

If the boot retained for the embodiment has sufficient rigidity, the choice of an insert of maximum compactness is appropriate to optimize the weight. This is adapted to boots made of plastic materials or of leather, but whose sole is reinforced in the front portion. For a flexible boot whose sole is not reinforced, it is preferable to extend the front of the insert up to the front end of the sole. The insert provides the necessary rigidity for the tensioning of the elastic return.

In the second embodiment, which is not shown in the Figures, the boot, the sole and the elements affixed thereto are similar to the first embodiment, except for the geometry of the rear surface 33 of the insert. This rear surface of the insert describes a portion of a surface having an axis of revolution, located in a plane defined by the vertical, the longitudinal axis of the ski and the center of the ski. The abutment 2, 3, the antifriction plate 7, the plate 4 and the raising plate 5 are similar to the first embodiment, except for the fact that these plates no longer have any housing in their thickness for passage of a cable. On the contrary, the rear element, the elastic return and the closure system are different since all of the functions played by these entities are gathered in the rear element.

The description of the rear element will not be in detail since this is an alpine ski binding heel. This release binding element for an alpine ski, well known to the one skilled in the art, is positioned on the ski by appropriate means, at the rear of the insert.

However, a few constructive characteristics of the rear element will next be summarized. The rear element is translationally movable along the longitudinal axis of the ski. It is guided in a slide by appropriate means. The slide is fixed to the ski according to the first embodiment. The elastic return means is constituted by a spring housed in a recess provided for this purpose in the rear element. This spring, whose axis coincides with the longitudinal axis of the ski, has its surface located toward the front of the ski, in support on the rear element, whereas its other surface is connected by appropriate means to the slide, on the side of the rear of the ski. The front portion of the rear element is rotationally movable along an axis that is horizontal and transverse to the ski with respect to the remainder of this element.

The front surfaces of the rotationally movable portion of the rear element have a curvature complementary to that of the rear surface of the insert. The other characteristics of the rotationally movable portion are defined such that they ensure the conventional functioning of the heel in contact with the rear, lower and upper walls of the insert, according to a known technology.

The positioning of the boot in the binding is similar to the first embodiment, up to the downward tilting movement of the boot. Prior to the lower surface of the sole resting on the plate, the rear lower wall of the insert enters into contact with the rotationally movable portion of the rear element. The skier then exerts on the insert a vertical downward pressure. This action simultaneously causes a rotation of the movable portion of the rear element and a backward motion of the rear element on its slide. The rotation, which places the lower surface of the sole in contact with the upper surfaces of the plates on the ski, engages a complex closure system which maintains a vertical pressure on the rear and upper surfaces of the insert. The backward motion, which compresses the spring of the rear element, enables the rear element to apply a horizontal pressure forwardly on the rear surfaces of the insert which maintains the front end of the sole in the abutment.

The functioning, when disengaging the boot under the effect of a substantial torsional force, is similar to the first embodiment.

When one desires to voluntarily disengage the boot from the binding, the skier exerts a force, according to a known practice, on the upper surface of the rear element. This force causes the opening of the closure system which causes an upward pivoting of the rotationally movable portion and thus releases the insert. A forward tilting movement of the boot releases it from the binding.

It is advisable to recall that the remarks on the industrial application of the first embodiment, regarding the choice of the abutment, the ski brake and the choice of the boots remain valid for this embodiment. Moreover, the rotationally immovable portion of the heel is sized so as to be housed between the upper surface of the ski and the lower surface of the sole when the boot is flat with respect to the ski.

Figure 6:
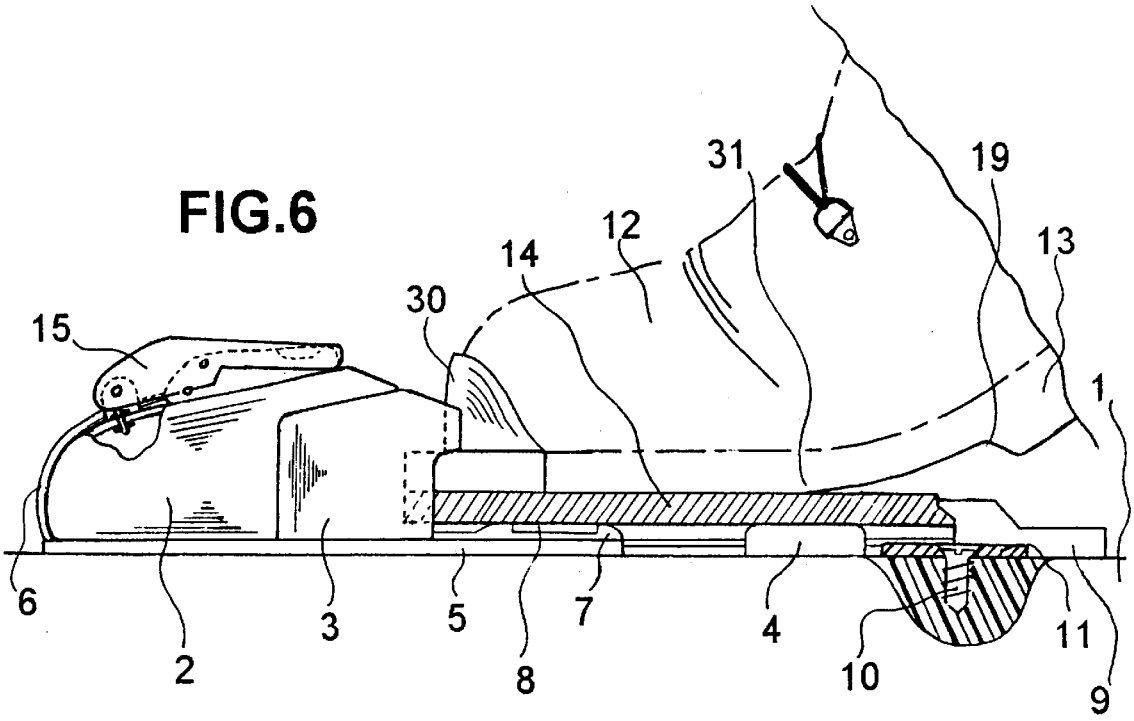
FIG. 6 is a side view of a variation of the first embodiment of the invention.
Figure 7:
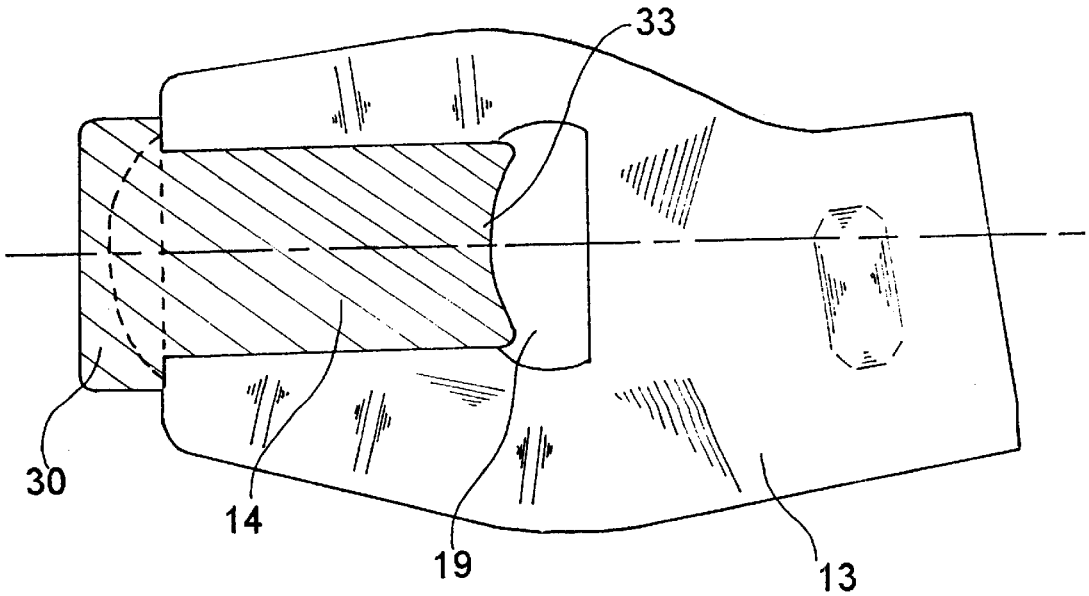
FIG. 7 illustrates the variation of the first embodiment, in a bottom view of the boot, the elements being different from the basic solution.

In the variation of the first embodiment, which is shown in FIGS. 6 and 7, the binding of the insert on the sole is different. All the other constituent elements, their arrangements and functioning are similar to the first embodiment.

Only the front portion (located on the left in FIG. 6) of the insert 14 is affixed to the sole 13. This zone, which is fixed to the sole by appropriate means, is comprised between the front end of the insert 14 and a position 31 located between the same end and the rear surfaces 33 of the insert. Behind this position, the lower surface of the recess 19 in the sole 13 can separate from the upper surface of the insert 14.

This variation makes it possible to dissociate the point of flexion 31 of the boot from the rear end 33 of the insert. The position 31 is determined as a function of the zone of flexion of the boot desired by the skier.

This variation is also valid for the second embodiment.

This variation can be used advantageously for small sized boots whose zone corresponding to the metatarsal bones is too close to the front end of the boot. It makes it possible to place the point of flexion of the boot at the level of the metatarsal bones, whereas the rear of the insert is located behind this point as a function of the minimum distance that is technically possible between the abutment and the rear element.

I claim:

1. A release binding for releasably holding a boot on a ski during telemark skiing, back country skiing, and ski jumping, the boot having a sole with an insert, said release binding comprising:

a release abutment configured to engage a front portion of the sole of the boot, said release abutment enabling lateral or diagonal disengagement of the boot under a substantial torsional force;

a rear element configured to engage the insert of the sole; and an elastic return device adapted to exert an elastic force between said release abutment and said rear element to secure the insert of the sole therebetween.

2. A release binding according to claim 1, further comprising:

a longitudinal guide, said rear element is positioned for sliding longitudinally along the ski in said longitudinal guide.

3. A release binding according to claim 2, wherein:

said rear element is biased for movement along said longitudinal guide by means of said elastic return device.

4. A release binding according to claim 1, wherein:

said rear element has a front surface adapted to contact the insert of the sole of the boot, said front surface of said rear element describing a portion of a surface formed by a vertical axis of revolution defined by a vertical longitudinal plane of the ski and the center of the ski.

5. A release binding according to claim 4, wherein:

said portion of said surface is an inverted inclination curve.

6. A release binding according to claim 1, wherein:

said release abutment includes a fixed portion, a movable portion, and a spring defining a threshold force against which said movable portion is movable; and said elastic return device is independent of said spring.

7. A release binding according to claim 1, further comprising:

a closure system to activate said elastic return device.

8. A release binding according to claim 7, wherein:

said closure system includes a manipulation element movable between an activated position and a non-activated position, and means for connecting said manipulation element to said rear element; and in said non-activated position, the boot is insertable into the release binding and, in said activated position, said release abutment and said rear element are in engagement with the insert of the sole of the boot and, in said activated position, said elastic return device exerts the elastic return force to secure the insert between the release abutment and said rear element.

9. A release binding according to claim 8, wherein:

said means for connecting said manipulation element to said rear element comprises a cable.

10. A release binding according to claim 1, wherein:

said rear element and said elastic return device comprise a heel binding for an alpine ski.

11. A release binding according to claim 1, wherein:

said rear element is adapted to engage the insert of the sole of the boot, in which the insert has an upper surface and said upper surface is entirely affixed to the sole of the boot.

12. A release binding according to claim 1 in combination with said boot, wherein:

said insert of said sole of said boot has an upper surface and said upper surface is entirely affixed to said sole of said boot.

13. A release binding according to claim 1 in combination with said boot, wherein:

said boot has a flexion point; and said insert of said sole has a front portion, only said front portion of said insert being affixed to said sole, said front portion of said insert being located forward of the flexion point of said boot.

14. A release binding and boot according to claim 13, wherein:

said flexion point of said boot is located in an area of the metatarsal bones of the foot of the wearer of said boot.

15. A release binding for releasably holding a boot on a ski during telemark skiing, back country skiing, and ski jumping, the boot having a sole with an insert, said release binding comprising:

a release abutment configured to engage a front portion of the sole of the boot, said release abutment enabling lateral or diagonal disengagement of the boot under a substantial torsional force;

a rear element configured to engage the insert of the sole;

a longitudinal guide, said rear element being positioned for sliding longitudinally along the ski in said longitudinal guide; and an elastic return device adapted to exert an elastic force from said rear element to said insert of the sole.

16. A release binding according to claim 15, further comprising:

a closure system to activate said elastic return device, said closure system including a manipulation element movable between an activated position and a non-activated position, and a force-transmitting element extending between said rear element to said manipulation element; and in said non-activated position, the boot is insertable into the release binding and, in said activated position, said release abutment and said rear element are in engagement with the insert of the sole of the boot and, in said activated position, said elastic return device exerts the elastic return force to secure the insert between the release abutment and said rear element.

17. A release binding according to claim 15, further comprising:

a longitudinal guide, said rear element is positioned for sliding longitudinally along the ski in said longitudinal guide.

18. A release binding according to claim 17, wherein:

said rear element is biased for movement along said longitudinal guide by means of said elastic return device.

19. A release binding for releasably holding a boot on a ski, the boot having sole having an engagement member, said release binding comprising:

a release abutment having a fixed portion, a movable portion, and a spring defining a threshold force against which said movable portion is movable, said movable portion being laterally movable with respect to said fixed portion and being configured to engage a front portion of the sole of the boot, said movable portion being mounted for release of the front portion of the sole of the boot upon exertion of a release force beyond said threshold force;

a rear element configured to engage the engagement member of the sole; and an elastic return device, independent of said spring, exerting an elastic force between said release abutment and said rear element to secure the insert of the sole therebetween.

20. A release binding according to claim 19, further comprising:

a longitudinal guide, said rear element is positioned for sliding longitudinally along the ski in said longitudinal guide.

21. A release binding according to claim 20, wherein:

said rear element is biased for movement along said longitudinal guide by means of said elastic return device.

22. A release binding according to claim 19, wherein:

said rear element has a front surface adapted to contact the insert of the sole of the boot, said front surface of said rear element describing a portion of a surface formed by a vertical axis of revolution defined by a vertical longitudinal plane of the ski and the center of the ski.

23. A release binding according to claim 22, wherein:

said portion of said surface is an inverted inclination curve.

24. A release binding according to claim 19, further comprising:

a closure system to activate said elastic return device.

25. A release binding according to claim 24, wherein:

said closure system includes a manipulation element movable between an activated position and a non-activated position, and means for connecting said manipulation element to said rear element; and in said non-activated position, the boot is insertable into the release binding and, in said activated position, said release abutment and said rear element are in engagement with the insert of the sole of the boot and, in said activated position, said elastic return device exerts the elastic return force to secure the insert between the release abutment and said rear element.

26. A release binding according to claim 25, wherein:

said means for connecting said manipulation element to said rear element comprises a cable.

27. A release binding according to claim 19, wherein:

said rear element and said elastic return device comprise a heel binding for an alpine ski.

28. A release binding according to claim 19, wherein:

said rear element is adapted to engage the insert of the sole of the boot, in which the insert has an upper surface and said upper surface is entirely affixed to the sole of the boot.

29. A release binding according to claim 19 in combination with said boot, wherein:

said insert of said sole of said boot has an upper surface and said upper surface is entirely affixed to said sole of said boot.

30. A release binding according to claim 19 in combination with said boot, wherein:

said boot has a flexion point; and said insert of said sole has a front portion, only said front portion of said insert being affixed to said sole, said front portion of said insert being located forward of the flexion point of said boot.

31. A release binding and boot according to claim 30, wherein:

said flexion point of said boot is located in an area of the metatarsal bones of the foot of the wearer of said boot.

* * * * *